US008079583B2

(12) United States Patent
Milillo

(10) Patent No.: US 8,079,583 B2
(45) Date of Patent: Dec. 20, 2011

(54) COMPILING BELT SYSTEM WITH MOVING STAPLER

(75) Inventor: Richard J. Milillo, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 147 days.

(21) Appl. No.: 12/339,314

(22) Filed: Dec. 19, 2008

(65) Prior Publication Data

US 2010/0156022 A1 Jun. 24, 2010

(51) Int. Cl.
*B65H 37/04* (2006.01)

(52) U.S. Cl. ..... 270/52.18; 271/230; 271/238

(58) Field of Classification Search ..... 270/52.18; 271/230, 238, 193, 208
See application file for complete search history.

(56) References Cited

U.S. PATENT DOCUMENTS

| | | | | |
|---|---|---|---|---|
| 4,522,383 A | | 6/1985 | Macey | |
| 4,767,116 A | * | 8/1988 | Eberle | 271/238 |
| 5,174,557 A | * | 12/1992 | Meier | 270/38 |
| 5,320,336 A | * | 6/1994 | Asami | 270/58.08 |
| 5,417,410 A | | 5/1995 | Meier | |
| 6,048,119 A | * | 4/2000 | Kato et al. | 400/624 |
| 6,293,544 B1 | * | 9/2001 | Fedinatz | 271/243 |
| 6,341,777 B1 | * | 1/2002 | Carter | 271/291 |
| 2004/0256782 A1 | * | 12/2004 | Milillo et al. | 270/58.01 |

FOREIGN PATENT DOCUMENTS

EP 0566531 A1 10/2010

OTHER PUBLICATIONS

Partial European Search Report for EP09178021.3, mailed May 4, 2010.

* cited by examiner

*Primary Examiner* — Patrick Mackey
(74) *Attorney, Agent, or Firm* — Fay Sharpe LLP

(57) ABSTRACT

As set forth herein, a finisher module within an automated print system is described. A compiler delivery system receives and organizes one or more sheets in a predetermined configuration for delivery. A compiling belt system receives the one or more sheets from the compiler deliver system, locates the one or more sheets and transports the sheets concurrent to one or more finishing processes. A side tamper system moves alongside the compiling belt system to side tamp and register sheets in the cross process direction. A stapler/stitcher assembly moves alongside the compiling belt system to perform at least one of a stapling and a stitching operation as the one or more sheets are transported.

19 Claims, 3 Drawing Sheets

COMPILING BELT SYSTEM WITH MOVING STAPLER

TECHNICAL FIELD

The presently disclosed embodiments are directed to a sheet finisher module system that operates concurrently with various finishing operations. In this manner, sheets can enter a compiling system consisting of multiple independently driven belts for sheet handling. However, it is to be appreciated that the present exemplary embodiments are also amenable to other like applications.

BACKGROUND

Automated production is utilized by today's printers to output large capacity jobs. Such production can require any number of operations including printing, collating, cutting, stapling, stitching, etc. to output a product that meets predefined specifications. Bottlenecks within the production operation can slow or stop output. These inefficiencies can occur due to substandard designs, mechanical failure, control malfunction and the like.

In one example, finishing systems that create stapled or stitched cut sheet sets can be slowed by a number of processes. For instance, final set registration, stitching/stapling, and set ejection operations can hamper output. Typically, although time is allocated to perform these functions, they can nevertheless extend beyond the time available prior to the arrival of the next incoming sheets or sets. Thus, finishing operations can create a negative impact on productivity and work flow (e.g., skip pitches).

Buffering techniques and/or multiple compiler stations have been employed to overcome such inefficiencies. However, buffering can limit the page sizes employed and/or the size of a print job. This problem becomes even more challenging, costly and prohibitive as the volume rate or sheets per minute requirements increase (especially at the production market volume values). Therefore, productivity is decreased especially with regard to small stapled/stitched sets.

Accordingly, there is a need for a system that overcomes inefficient print production output, especially at it relates to finishing processes.

BRIEF DESCRIPTION

In one aspect, a finisher module within an automated print system is described herein. A compiler delivery system receives and organizes one or more sheets in a predetermined configuration for delivery. A compiling belt system receives the one or more sheets from the compiler deliver system, locates the one or more sheets and transports the sheets concurrent to one or more finishing processes. A stapler/stitcher assembly moves alongside the compiling belt system to perform at least one of a stapling and a stitching operation as the one or more sheets are transported.

In another aspect, a finisher module is utilized within an automated print system. A compiler delivery system receives and organizes one or more sheets in a predetermined configuration for delivery. A compiling belt system receives the one or more sheets on a plurality of belts to catch the leading and trailing edge of the one or more sheets as they are received from the compiler deliver system, locates the one or more sheets and transports the sheets concurrent to one or more finishing processes. A stapler/stitcher assembly moves alongside the compiling belt system to perform at least one of a stapling and a stitching operation as the one or more sheets are transported.

In yet another aspect, a computer implemented method is employed to finish a set of one or more sheets in an automated print production process. The set of sheets is received and organized in a predetermined configuration for delivery. The set of sheets is located after they have been organized. The set of sheets is transported concurrent to at least one of stapling and stitching based at least in part upon the set location as it moves through the print production process.

DETAILED DESCRIPTION

Figure 1:
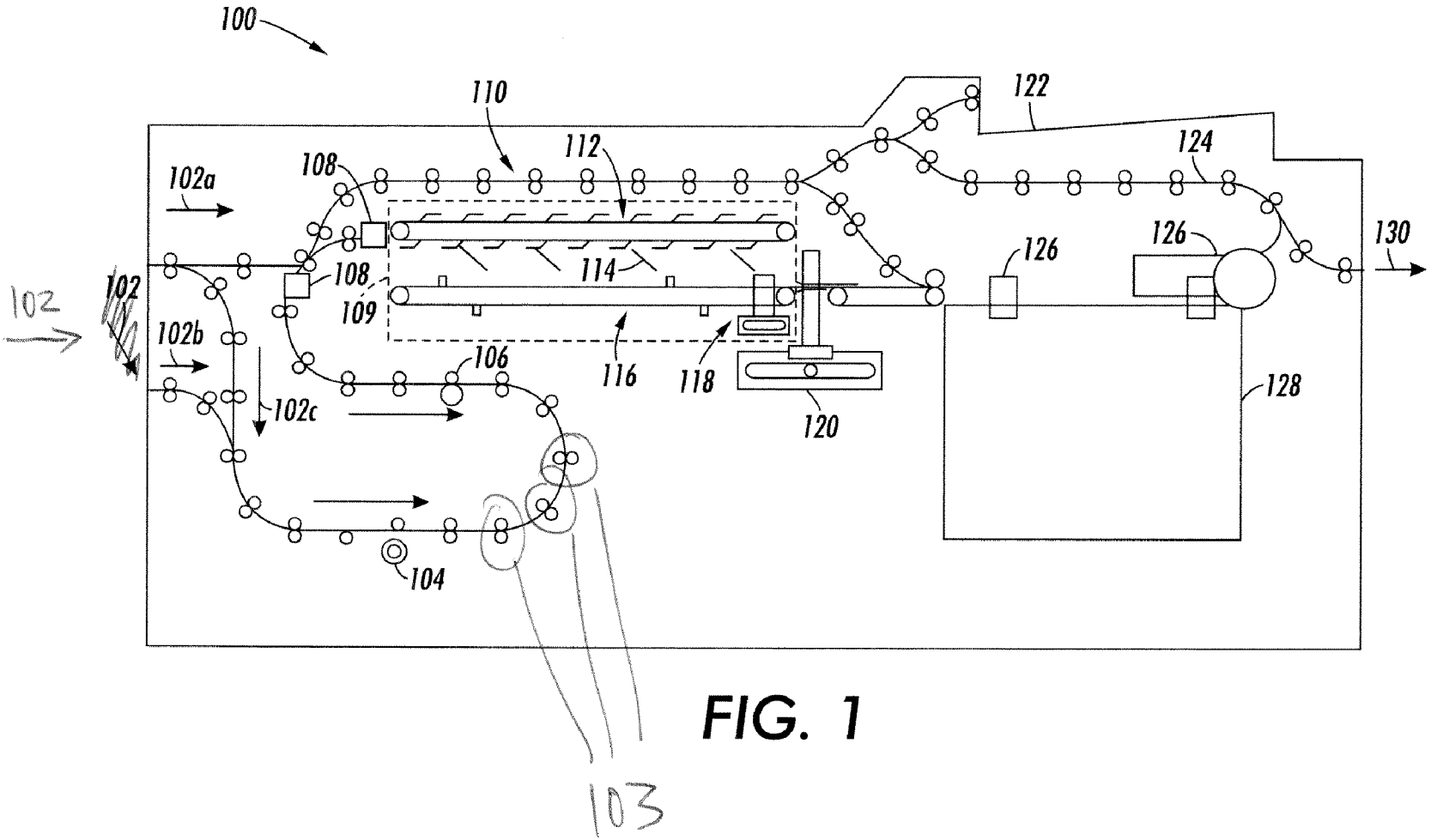
FIG. 1 is a schematic of a finisher module, in accordance with an exemplary embodiment.

FIG. 1 is a schematic diagram of a finisher module 100 within an automated print system. The module 100 includes a plurality of devices to perform various finishing processes related to the output of one or more print jobs. It is to be appreciated the automated print system can include any number of processing steps and/or operations such as printing, collating, duplex operations, binding, packaging, etc. For the sake of brevity, however, such steps will not be discussed in detail herein to focus solely on finishing and processes associated therewith. In addition, the term "sheet" as used herein, refers to any size, weight, color, thickness, etc. of sheets. A "set" as used herein refers to a plurality of sheets that are processed at substantially the same time.

Sheets are accepted by the finisher module 100 via a transport system 101, depicted as a line with a plurality of roller pairs 103 that advance sheets throughout the module 100. In this non-limiting example, the process direction of the module 100 is generally from left to right. That is, pages enter from the module from the left, undergo finishing and exit to the right to additional devices. Sheets can follow paths 102*a*, 102*b* or 102*c*, as required for each print job specification. Sheets following paths 102*b* and 102*c* can be registered as they pass through a registration system 104. A decurler 106 can mitigate curling as sheets exit the registration system 104. Alternatively, sheets that follow the path 102*a* can bypass the registration and decurling processes and proceed directly to a staple and/or stitching process.

Sheets can be transitioned via the transport system 101 to a compiling area 109, which includes a compiler delivery system transport 112 and a compiling belt system 116. While traveling to the compiling area 109, sheets can pass by one or more static eliminators 108 to mitigate deleterious effects of static associated with sheets in process. The compiler sheet delivery system 112 can deliver sheets at various process direction locations to the compiling belt system 116, which locates and transports sheets concurrent to one or more finishing processes.

This compiler delivery system 112 can utilize substantially any device for sheet transport such as a gripper, a clamp and/or a pinch type transport approach. The delivery system 112 is capable of carrying sheets over the compiling area 109 and dropping or releasing sheets at varying process direction locations and velocities as the compiling system 116 is stationary or is moved in the process direction. Other delivery approaches are contemplated wherein sheets are delivered to the compiling area 109 in the same fashion. In addition, a suppression system 114 (e.g., mechanical, pneumatic, etc.) can be used to assist in dropping sheets into the compiler area 109.

Figure 2:
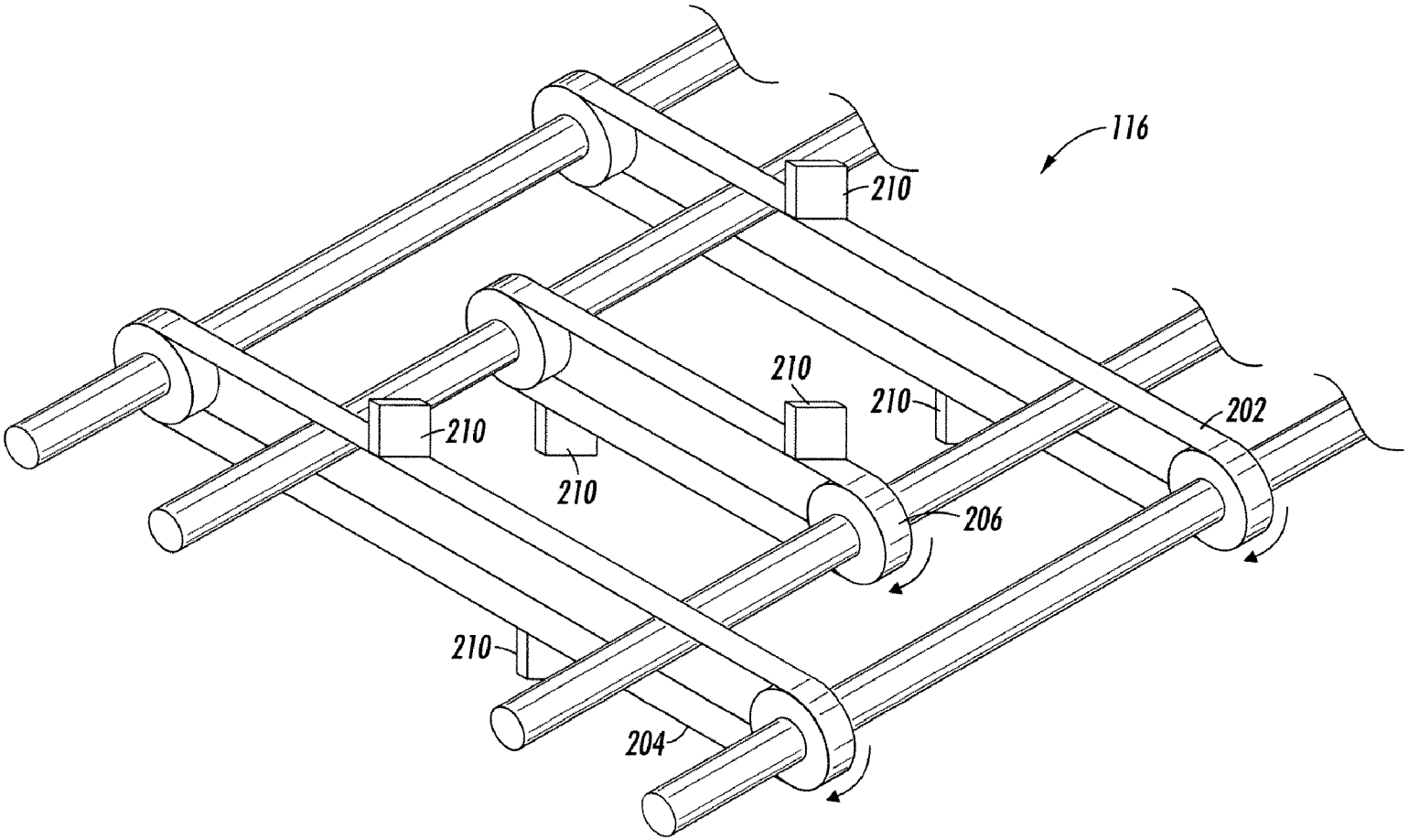
FIG. 2 is an isometric view of a compiler belt concept, in accordance with an exemplary embodiment.

The compiling area 109 utilizes a belt concept that consists of tamping tabs or plates attached to belts. FIG. 2 illustrates the compiling system 116 within the compiling area 109 in greater detail. Trail edge tamping belts 202 and 204 and a lead edge tamping belt 206 are employed. The belts 202-206 are driven independently (in the same direction) to provide a lead edge set registration while moving and holding the set in the process direction. Each belt 202-206 can be geared and driven as appropriate to align a plurality of tabs that on each belt at a given point in time. In one example, the tab location is dependent upon the operation of one or more of the compiler delivery system 112, the side tamper assembly 118, and the stapler/stitcher 120. Tabs on the trail edge belts 202 and 204 can be employed to push the set in the process direction. In addition, baffles (not shown) can be placed between the belts 202-206 to better support the sheet and/or sets. Additional belts and configurations are contemplated to produce the same function stated above.

The compiling area 109 also has a side tamper assembly 118, which includes a pair of independently driven side edge tampers for cross process sheet and/or set registration. These tampers operate to cross process register the sheet and/or set while the tampers are stationary or moving with the sheets/set at the same velocity in the process direction at the same time. A number of approaches can be used to achieve this desired side tamper motion. As the side tampers are driven separately they can be used to create offset sets for the stacker 128, if desired. After each tamping operation, the tampers will reset backward relative to the process direction, if required, to repeat the operation with next sheet and/or set.

The compiling area 109 may not move in the process direction at all times during the compiling of sets. For example, the bulk of a larger set may be compiled using the belt tampers (of the compiling belt system 116), the side tampers (of the side tamper assembly 118) and/or the suppression system 114 while not moving in the process direction. Process direction compiling and work flow can commence during the compiling of the last few sheets or sheet of the set to sustain productivity requirements of the next sheet and/or set entering. Having the system perform in this fashion will help reduce the length of the finisher module 100.

The belt system 116 moves sheets in the process direction to allow a staple/stitcher 120 assembly to staple and/or stitch sheets while on the compiling belt system 116. A side-tamper assembly 118 includes a pair of two assemblies (e.g., one on each side) that move inward and outward to allow the staple/stitcher 120 to operate while concurrently moving in the process direction. Once the stitching and/or staple operation is complete, the sheets are ejected to a stacker 128. In this manner, the output of the finisher module is not compromised, as sheets are registered, stitched and ejected to the stacker 128 while maintaining motion of the set in the process direction to maintain full productivity. Moreover, sheets from subsequent sets entering the module 100 can begin finishing without negatively impacting productivity (e.g., delays, skip pitches, etc.).

The stapler/stitcher assembly 120 that enable stapling and/or stitching while moving with the set in the process direction at the same speed, in the process direction, and at the same time. Alternatively or in addition, the assembly 120 can be mounted to a driven carriage device (not shown) to allow for stapling/stitching at various widths (e.g., at inboard and outboard positions). Ejection of the set to the stacker 128 is enabled by either the extension of the existing belt system, a pass off to another belt transport system (capable of maintaining set integrity), and/or a gripper clamp mechanism device that pulls the set to the stacker 128.

The stacker 128 can have an optional capability to move in a process and/or a cross-process direction to create offset sets. Offsetting can also be accomplished by upstream devices (e.g., side tampers, registration systems, etc.) which has been demonstrated in other finisher devices. Other stacking options such as cart systems and the like can be integrated into such a stacking function. The module 100 can also be configured to have a separate optional paper paths for unstapled/unstitched sheets that takes them directly to the stacker (e.g., via a bypass transport 110) and can be registered and compiled with one or more additional registration devices such as disc, friction, and/or tamping devices to provide better quality stacking. Additional configured paper paths can be used to lead to a purge tray 122 or a bypass transport and exit path 124 which leads to another downstream device 130.

The module 100 can be configured to have a purge tray 122 to eject any sheet sets that do not meet one or more predetermined requirements. A registration system 104 can be added to pre-register incoming sheets to the compiler belt system 116, the 128 stacker, the purge tray 122 and/or the bypass transport 124. In addition, the registration system 104 can be used to offset sheets before entering some or all of the of the previously mentioned finisher areas (e.g., bypass, compiling, top tray, stacker).

Figure 3:
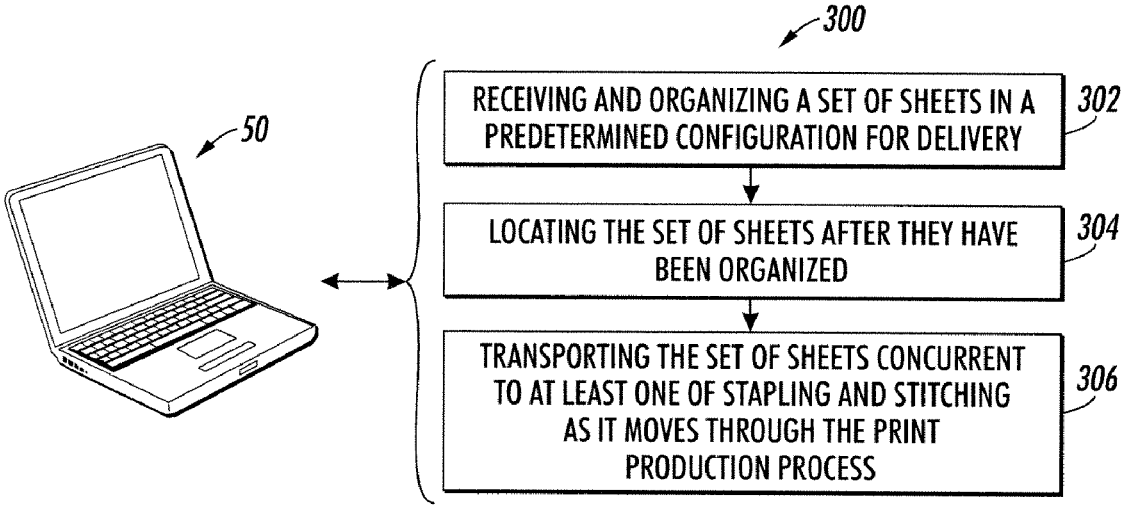
FIG. 3 illustrates a method to concurrently finish one or more sheets while in motion, in accordance with an exemplary embodiment.

FIG. 3 illustrates a computer implemented method 300 to transport sheets concurrent to one or more finishing operations. In this manner, sheets can be output from such an operation without having a negative impact. At reference numeral 302, the set of sheets is received and organized in a predetermined configuration for delivery. At 304, the set of sheets is located after they have been organized. At 306, the set of sheets is transported concurrent to at least one of stapling and stitching based at least in part upon the set location as it moves through the print production process.

A computer 50 illustrates one possible hardware configuration to support the systems and methods described herein, including the method 300 above. It is to be appreciated that although a standalone architecture is illustrated, that any suitable computing environment can be employed in accordance with the present embodiments. For example, computing architectures including, but not limited to, stand alone, multiprocessor, distributed, client/server, minicomputer, mainframe, supercomputer, digital and analog can be employed in accordance with the present embodiment.

The computer 50 can include a processing unit (not shown), a system memory (not shown), and a system bus (not shown) that couples various system components including the system memory to the processing unit. The processing unit can be any of various commercially available processors. Dual microprocessors and other multi-processor architectures also can be used as the processing unit.

The system bus can be any of several types of bus structure including a memory bus or memory controller, a peripheral bus, and a local bus using any of a variety of commercially available bus architectures. The computer memory includes read only memory (ROM) and random access memory (RAM). A basic input/output system (BIOS), containing the basic routines that help to transfer information between elements within the computer, such as during start-up, is stored in ROM.

The computer 50 can further include a hard disk drive, a magnetic disk drive, e.g., to read from or write to a removable disk, and an optical disk drive, e.g., for reading a CD-ROM disk or to read from or write to other optical media. The computer 50 typically includes at least some form of computer readable media. Computer readable media can be any available media that can be accessed by the computer. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other magnetic storage devices, or any other medium which can be used to store the desired information and which can be accessed by the computer.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above can also be included within the scope of computer readable media.

A number of program modules may be stored in the drives and RAM, including an operating system, one or more application programs, other program modules, and program non-interrupt data. The operating system in the computer 50 can be any of a number of commercially available operating systems.

A user may enter commands and information into the computer through a keyboard (not shown) and a pointing device (not shown), such as a mouse. Other input devices (not shown) may include a microphone, an IR remote control, a joystick, a game pad, a satellite dish, a scanner, or the like. These and other input devices are often connected to the processing unit through a serial port interface (not shown) that is coupled to the system bus, but may be connected by other interfaces, such as a parallel port, a game port, a universal serial bus ("USB"), an IR interface, etc.

A monitor, or other type of display device, is also connected to the system bus via an interface, such as a video adapter (not shown). In addition to the monitor, a computer typically includes other peripheral output devices (not shown), such as speakers, printers etc. The monitor can be employed with the computer 50 to present data that is electronically received from one or more disparate sources. For example, the monitor can be an LCD, plasma, CRT, etc. type that presents data electronically. Alternatively or in addition, the monitor can display received data in a hard copy format such as a printer, facsimile, plotter etc. The monitor can present data in any color and can receive data from the computer 50 via any wireless or hard wire protocol and/or standard.

The computer 50 can operate in a networked environment using logical and/or physical connections to one or more remote computers, such as a remote computer(s). The remote computer(s) can be a workstation, a server computer, a router, a personal computer, microprocessor based entertainment appliance, a peer device or other common network node, and typically includes many or all of the elements described relative to the computer. The logical connections depicted include a local area network (LAN) and a wide area network (WAN). Such networking environments are commonplace in offices, enterprise-wide computer networks, intranets and the Internet.

When used in a LAN networking environment, the computer is connected to the local network through a network interface or adapter. When used in a WAN networking environment, the computer typically includes a modem, or is connected to a communications server on the LAN, or has other means for establishing communications over the WAN, such as the Internet. In a networked environment, program modules depicted relative to the computer, or portions thereof, may be stored in the remote memory storage device. It will be appreciated that network connections described herein are exemplary and other means of establishing a communications link between the computers may be used The claims can encompass embodiments in hardware, software, or a combination thereof.

The word "printer" as used herein encompasses any apparatus, such as a digital copier, bookmaking machine, facsimile machine, multi-function machine, etc. which performs a print outputting function for any purpose.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A finisher module within an automated print system, comprising:

a compiler delivery system that receives and organizes one or more sheets in a predetermined configuration for delivery;

a compiling belt system that receives the one or more sheets from the compiler deliver system, locates the one or more sheets and transports the sheets concurrent to one or more finishing processes;

a stapler/stitcher assembly that moves alongside the compiling belt system to perform at least one of a stapling and a stitching operation as the one or more sheets are transported; and a side tamper assembly comprising a pair of independently driven side tamper assemblies that move inward and outward while moving in a process direction at substantially the same time and allows the stapler/stitcher assembly to operate while concurrently moving in the process direction.

2. The system according to claim 1, wherein the compiling belt system further includes:

n lead edge belts; and n+1 trail edge belts;

wherein the lead edge belts and the trail edge belts receive the one or more sheets and move them at a predetermined speed in a predetermined location.

3. The system according to claim 2, wherein the lead edge belts and the trail edge belts each contain one or more tabs that hold the one or more sheets in place for processing via the stapler/stitcher assembly.

4. The system according to claim 1, wherein the one or more sheets are ejected to a stacker upon completion of processing via the stapler stitcher assembly.

5. The system according to claim 4, further including:

a bypass transport that directs the one or more sheets past the compiler delivery system and ejects the one or more sheets directly into the stacker.

6. The system according to claim 5, wherein the finisher module further includes:

a compiling assembly station that receives the one or more sheets from the bypass transport for at least one of a compiling and an assembly operation.

7. The system according to claim 1, wherein the one or more sheets are registered at a registration system prior to receipt via the compiler deliver system.

8. The system according to claim 1, wherein the one or more sheets are processed via a decurler that mitigates curl associated with the one or more sheets.

9. The system according to claim 1, wherein the one or more sheets enter one or more static eliminators that minimize static associated with the one or more sheets.

10. The system according to claim 1, wherein the finisher module further includes:

a purge tray that ejects one or more sheets that do not meet a predetermined criteria.

11. The method of claim 1, wherein the pair of independently driven side tamper assemblies reset in a direction opposite the process direction upon completion of a tamping operation.

12. A finisher module within an automated print system, comprising a compiler delivery system that receives and organizes one or more sheets in a predetermined configuration for delivery;

a compiling belt system that receives the one or more sheets on a plurality of belts to catch the leading and trailing edge of the one or more sheets as they are received from the compiler deliver system, locates the one or more sheets and transports the sheets concurrent to one or more finishing processes; and a stapler/stitcher assembly that moves alongside the compiling belt system to perform at least one of a stapling and a stitching operation as the one or more sheets are transported;

wherein the one or more sheets experience cross process registration via independently driven side tamping devices that tamp in and out in the cross process direction while the side tamping devices move in the process direction with the one or more sheets while moving inward and outward and allowing the stapler/stitcher assembly to operate while concurrently moving in the process direction.

13. The finisher module as set forth in claim 12, wherein the one or more sheets are delivered from the compiling delivery system to the compiling belt system.

14. The finisher module as set forth in claim 12, wherein the at least one of stapling and stitching operation is performed on the same side of the one or more sheets.

15. The finisher module as set forth in claim 12, wherein an incoming set of one or more sheets is processed in substantially immediate succession from a current stapling and stitching operation.

16. The finisher module as set forth in claim 12, wherein the output of the compiling belt system is substantially equivalent to the input of the finisher module.

17. The system according to claim 12, wherein the compiling belt system further includes a baffle between each pair of belts to support the one or more sheets received for processing.

18. A computer implemented method to finish a set of one or more sheets in an automated print production process, comprising:

receiving and organizing the set of sheets in a predetermined configuration for delivery;

locating the set of sheets after they have been organized; and transporting the set of sheets concurrent to at least one of stapling and stitching based at least in part upon the set location as it moves through the print production process;

wherein the one or more sheets experience cross process registration via independently driven side tamping devices that tamp in and out in the cross process direction while moving the one or more sheets in the process direction.

19. The finisher module of claim 12, wherein the independently driven side tamping devices reset in a direction opposite the process direction upon completion of a tamping operation.

* * * * *